US006114669A

United States Patent [19]

Van Mil et al.

[11] Patent Number: 6,114,669

[45] Date of Patent: Sep. 5, 2000

[54] APPARATUS FOR CONTROLLING THE POWER SUPPLY TO A LOAD IN A REPRODUCTION APPARATUS, MORE PARTICULARLY TO A FIXING UNIT

[75] Inventors: Cornelis B. M. Van Mil, Herkenbosch; Hendrik W. Ellenkamp, Venlo, both of Netherlands

[73] Assignee: Oce-Technologies B.V., Venlo, Netherlands

[21] Appl. No.: 09/104,194

[22] Filed: Jun. 25, 1998

[30] Foreign Application Priority Data

Jun. 25, 1997 [NL] Netherlands ..... 1006388

[51] Int. Cl.[7] ..... H05B 1/02

[52] U.S. Cl. ..... 219/497; 399/67

[58] Field of Search ..... 219/494–497, 219/347, 216, 492, 501; 355/14 E, 14 R

[56] References Cited

U.S. PATENT DOCUMENTS 4,355,225 10/1982 Marsh .
4,493,984 1/1985 Yamauchi .
4,711,560 12/1987 Hosaka et al. ..... 335/14 C
5,669,038 9/1997 Kishimoto ..... 399/67

FOREIGN PATENT DOCUMENTS

A5-44980 2/1993 Japan .
2108730A 5/1983 United Kingdom .

OTHER PUBLICATIONS

European Abstract: Heater Controller, 09106215, Apr. 22, 1997, Ricoh Co., Ltd.
European Abstract: Image Forming Device, 09146422, Nov. 22, 1995, Nanba Kuniharu.

*Primary Examiner*—Teresa Walberg
*Assistant Examiner*—Jeffrey Pwu

[57] ABSTRACT

A power supply circuit for accurately and instantaneously supplying power from the mains to an electrical load, more particularly a fixing unit and/or paper preheating unit in a copying machine or printer provided with such a circuit. In this power supply circuit, flicker (voltage fluctuations) induced in the mains and interference radiation are reduced as far as possible. The power supplied is controlled for this purpose by a solid state relay (SSR) operated with phase cutting, the phase angle of the switching signal being varied around a phase angle corresponding to the power supplied.

21 Claims, 5 Drawing Sheets

APPARATUS FOR CONTROLLING THE POWER SUPPLY TO A LOAD IN A REPRODUCTION APPARATUS, MORE PARTICULARLY TO A FIXING UNIT

FIELD OF THE INVENTION

The invention relates to apparatus for controlling the power supply to a load in a reproduction apparatus, more particularly to a heating unit therein.

BACKGROUND OF THE INVENTION

There is an increasing demand further to reduce the energy consumption of reproduction apparatuses, e.g., photocopiers. In reproduction apparatuses of the type which fix a toner image on the support material by way of heat, a considerable portion of the drawn power is consumed by the fixing unit. The fixing unit ensures that a toner image adheres firmly to the support material by heat or by a combination of heat and pressure.

The energy consumption of a fixing unit can be reduced by generating heat in the fixing unit only when such heat really is required, i.e. at the time that toner really has to be fixed on a receiving sheet. This requires a fixing apparatus which can respond rapidly. Instant fixing units having a small heat capacity are suitable for this purpose. A description of such a fixing apparatus can be found in U.S. Pat. No. 4,355,225 to Marsh.

However, to obtain a good result, the fixing unit must be able to retain a specific temperature accurately during fixing. This necessitates accurate power control. Such accurate control is made possible by using an electronic switching element, such as a thyristor, triac or solid state relay.

A problem with such circuits is the formation of higher harmonics due to steep slopes in the waveform at the switching times, resulting in contamination of the mains. An example of a main is a power line that usually terminates in a wall socket and into which, usually, is plugged the reproduction apparatus. It is known to avoid these higher harmonics by switching at the times when the instantaneous voltages cross the zero-axis. The power supply can then be controlled by passing or blocking half periods in a suitable way. Such a power control circuit is described in U.S. Pat. No. 4,377,739 to Eckert, Jr. et al.

However, as a result of the pulsed consumption of large amounts of power taken from the mains, there are associated pulsating heavy currents drawn from the mains, which cause voltage variations to occur on the mains. These voltage variations on the mains cause flicker. Flicker is defined as "an impression of unsteadiness of visual sensation induced by a light stimulus whose luminance or spectral distribution fluctuates with time", in the International Standard CEI/IEC 1000-3-3 (the Flicker Standard).

Flicker is annoying to the user and is manifest by the fact that lamps which are connected to the mains, to which the reproduction apparatus is also connected, start flickering. The Flicker Standard describes two quantities by which flicker is characterised: the "short term flicker indicator" $P_{st}$ and the "long term flicker indicator" $P_{lt}$. The first relates to the intensity (severity) of the flicker evaluated over a short period (a few minutes), and the second relates to the intensity (severity) of the flicker evaluated over a longer period (a few hours).

Flicker can be reduced by switching a solid state relay (SSR), not at the zero-cross times, but by applying phase angle control, i.e., phase cutting. However, this causes unwanted radiation. The above considerations also apply to other loads in a reproduction apparatus which draw high power from the mains, for example a paper preheating unit.

SUMMARY OF THE INVENTION

An object of the invention is to provide an apparatus for controlling power supply to a load in a reproduction apparatus such as a printer or photocopier, which can switch instantaneously, and with which there is a reduction to a far-reaching degree of both voltage fluctuations induced in the mains, which cause flicker, and contamination of the mains due to higher harmonics.

The apparatus for controlling the invention generates a switching signal at a phase angle varying in time with respect to the zero-cross of the substantially sinusoidal signal present in the main circuit. Moreover, the phase angle is varied over time around a phase angle set-point determined according to the power control signal.

Since power is supplied gradually, voltage fluctuations are minimised. Since the phase angle control is varied with a constant power requirement, higher harmonics are present to a much reduced degree compared with a fixed phase angle. The method prevents phase cutting from occurring at exactly the same phase angle each half period, so that a sharp peak in the frequency spectrum of the harmonics is avoided. For example, reflections on the mains of the higher harmonics destructively interfere rather than constructively interfere if the occurrences of the control signal are varied over time, i.e., if the phase angle changed over time.

Another improvement is obtained if the phase angle varying periodically in time varies between two extreme values and when one extreme value is reached the step value remaining at that time is used as an offset for the next phase angle for generation. The effect of this is that the phase angles of the respective phase cutting signals do not have the same value after a number of periods have elapsed. This flattens the harmonic spectrum still further.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
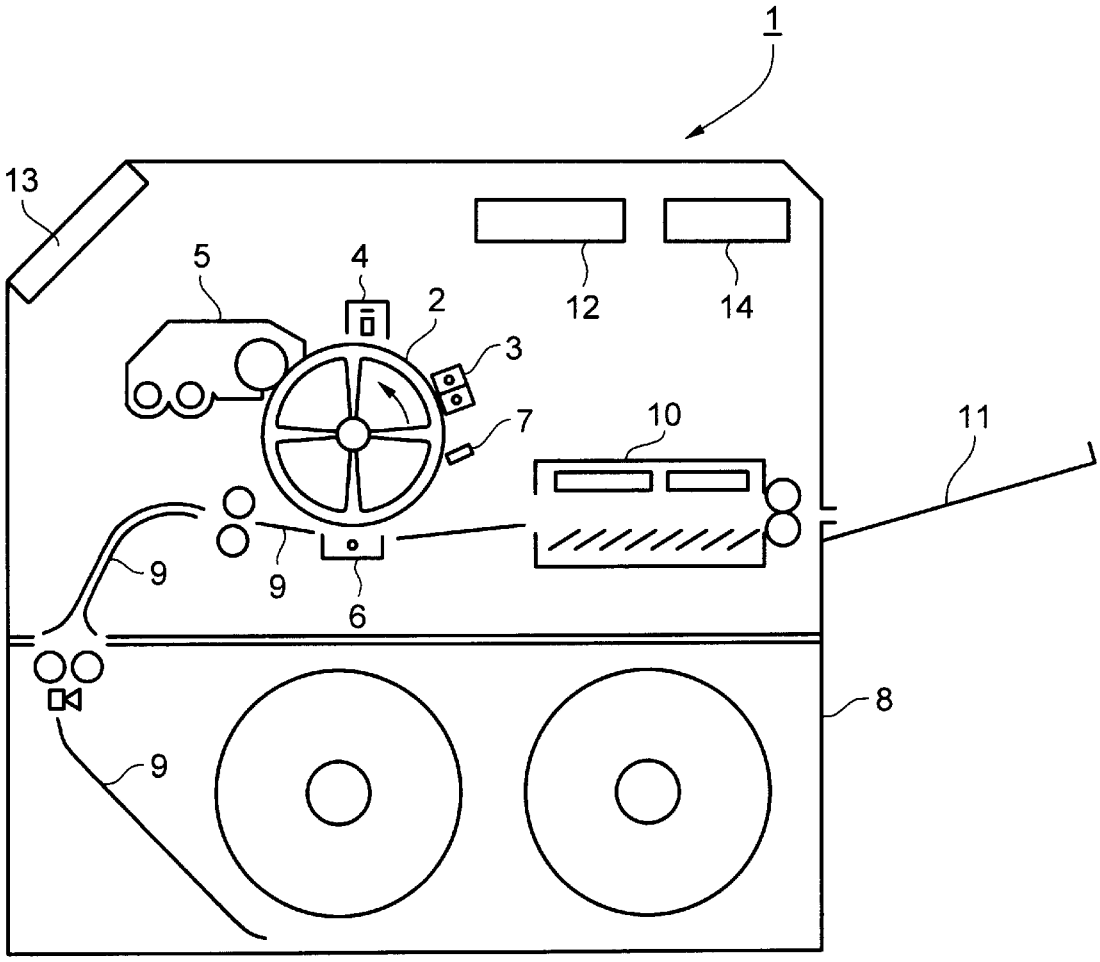
FIG. 1 diagrammatically illustrates a printing apparatus.

FIG. 1 shows an electrophotographic reproduction apparatus 1. This apparatus comprises a photoconductor 2 in the form of a drum surrounded by, successively, a charging device 3, an LED array 4, a developing station 5, a transfer station 6, and a cleaner 7. There is additionally a paper magazine 8. A sheet is fed via the paper path 9 along the transfer station 6, passes the fixing unit 10 and is deposited in the copy tray 11. A central control unit 12 ensures that all the above functions come into operation at the correct times and ensures that the adjustments made by a user on the operating panel 13 are carried out and also communication with a connected scanner (not shown) and with a network for processing print orders. A power supply circuit 14 provides the supply of power from the mains to the fixing unit 10.

During a printing operation, the photoconductor rotates in the direction of the arrow and the area of the photoconductor in the vicinity of the charging device 3 is charged up to a high negative voltage. This area then passes the LED array 4. An original image for printing and available in electronic form is fed to the LED array and the latter projects the image (black writer) line-by-line to the photoconductor. At those places where the photoconductor is exposed there is locally conduction and the charge flows away there. In this way a charge image is formed on the photoconductor in accordance with the original image.

During the passage along the developing station 5 toner is applied to the exposed areas. At the transfer station 6 the toner image is electrostatically transferred to a sheet of copy material fed longitudinally via the paper path 9 from the paper magazine 8. Cleaner 7 ensures that any toner residues are removed from the photoconductor. The sheet of copy material provided with the toner image is then fed through fixing unit 10. Here the toner is brought to a temperature such that it softens and adheres to the copy material. The sheet is then delivered and deposited in a copy tray 11.

Figure 2:
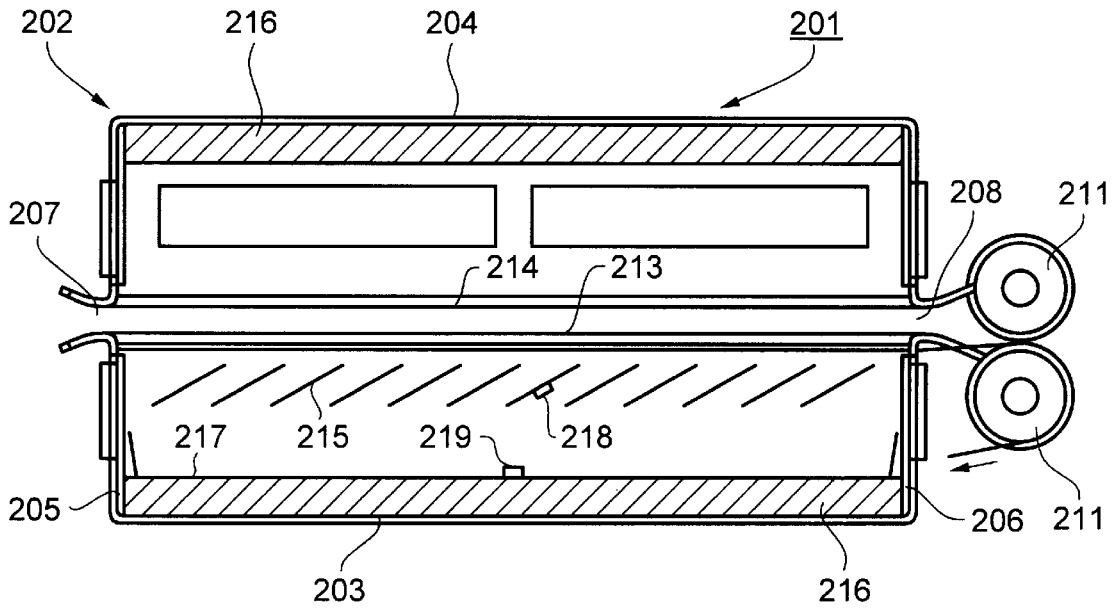
FIG. 2 is a fixing unit of the type adapted to deliver power instantaneously'

FIG. 2 shows an example of fixing unit 201 one that is of the type adapted to deliver power instantaneously. The fixing device includes a tubular housing with outer walls which form a protective hood 202 with a horizontal bottom wall 203, a horizontal top wall 204 and four vertical side walls. Openings 207 and 208 in the form of slots are formed respectively in two opposite side walls 205 and 206 of the protective hood 202 and extend horizontally over substantially the entire width of the associated side walls at mid-height thereof, with a width of, e.g. 6 mm and a length of, e.g. 900 mm. Transport rollers 211 are disposed outside the housing 201 near the slot 208 in order to feed via a transport path in the housing the sheet of copy material provided with a toner image.

The transport path in the housing 201 is formed by sheet guide wires 213 and 214 which are respectively trained beneath and above the transport path between the side walls 205 and 206 in a direction which forms an acute angle with the direction of transport of a sheet through the housing 201. At the slot 207 where a sheet enters the housing 201 the distance between the wires 213 and 214 is larger than in the case of the slot 208 where the sheet leaves the housing 201. The sheet guide wires 213 and 214 are made of, e.g., 0.4 mm thick stainless steel.

Slats 215, which form a radiator, are disposed beneath the sheet guide wires 213 forming the bottom of the sheet transport path. Each slat 15 is a resistive heating element. The slats 215 extend transversely with respect to the sheet transport direction. Each is formed from, e.g., a 9.6 mm wide strip of stainless steel, e.g., 0.05 mm thick. The sides of the slats 215 facing the paper path are sprayed with a coat of heat-resistant black paint. For example, on connection to 220 volts the radiator delivers a power of 2000 W.

Two strip parts situated next to one another in the sheet transport direction partially overlap one another. The radiator strip is notched at the time of manufacture by pulling the strip between two gearwheels. In this way a mechanical prestressing is obtained such that on expansion as a result of the temperature rise the strips do not sag.

The slats 215 are connected in series to produce an electrical resistance of, e.g., 24 ohms. The inside of the protective hood 202 is covered with a layer of heat-insulating material 216. A heat-reflecting plate 217 of, e.g., 1 mm thick reflector aluminium is disposed beneath the radiator. To control the energy supply to the radiators, a temperature sensor 218 in the form of a negative temperature coefficient resistor (NTC) is fixed on a slat of the radiator in the middle of the housing 201. A second temperature sensor 219, also constructed as an NTC, is disposed at the bottom of the fixing unit and gives an indication of the ambient temperature. The signal generated as a result is used as a correction to the set-point.

As an example, for receiving material of a weight of 75 g/m2, a radiator temperature of about 320° C. is sufficient to reach a sheet temperature of about 100° C. in the transit time of 5 meters per minute, this temperature being required (preferably) to fix the toner image.

Figure 3:
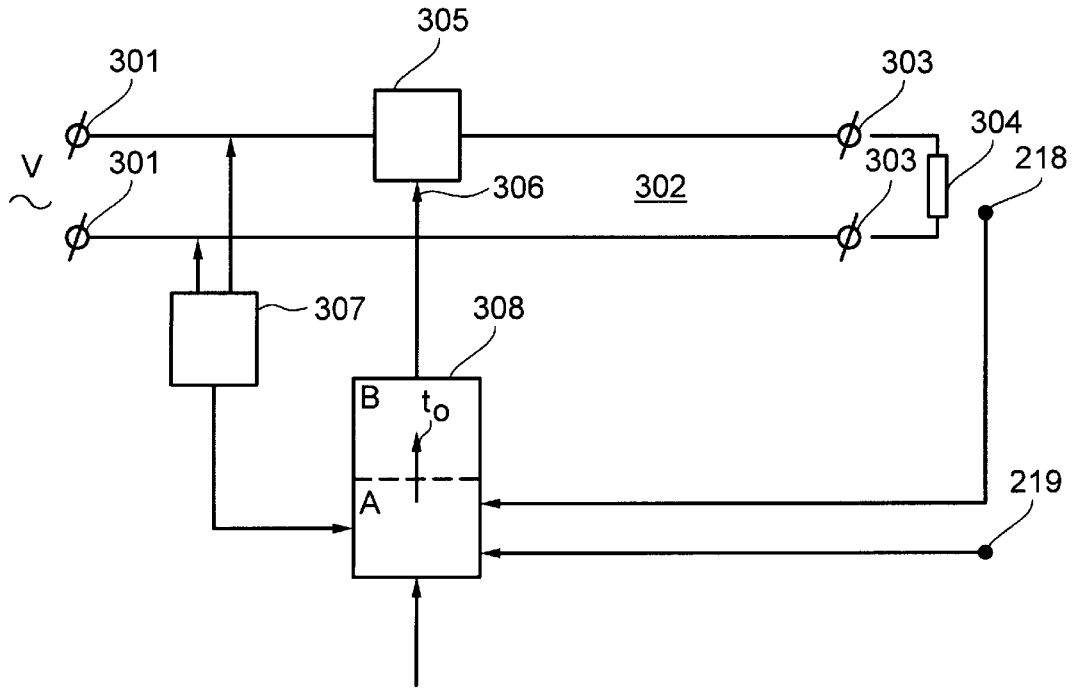
FIG. 3 is a block diagram of a supply circuit according to the invention.

FIG. 3 is a block diagram of the power supply circuit according to the invention. It is connected via connection points 301 to the mains, from which the power required is drawn. This power is fed to the connection points 303 via the main circuit 302, the radiator slats denoted by reference 304 in the drawing, of the fixing unit, being connected to said points 303.

The main circuit 302 includes a solid state relay 305 (SSR). This SSR 305 is rendered conductive by the application of a switching signal to the control electrode 306. When the AC voltage for switching in the main circuit 302 passes through zero, the SSR 305 returns to the open state. The power to be supplied to the load is now controlled by making the SSR conductive during a specific part of a half period of the voltage on the power supply circuit. The phase angle at which the switching signal is applied each time to the control electrode 306 is an indication of the power passed. In order that the switching signal may always be able to switch at the same time in the phase of the voltage in the main circuit 302, synchronisation with the AC voltage is required. For this purpose, a zero-cross detector 307 is provided, which detects when the AC voltage in the main circuit 302 crosses the zero axis.

Figure 6A:
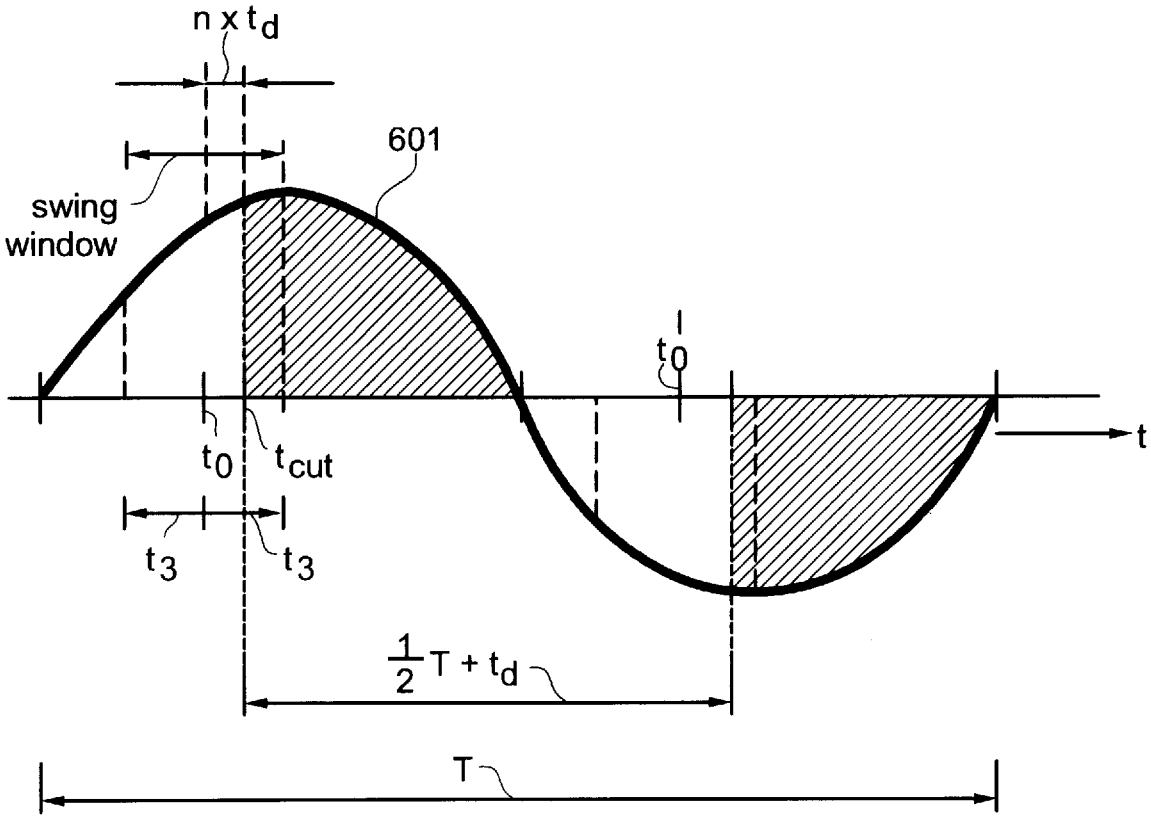
FIGS. 6A and 6B are time diagrams of the signals involved.
Figure 6B:
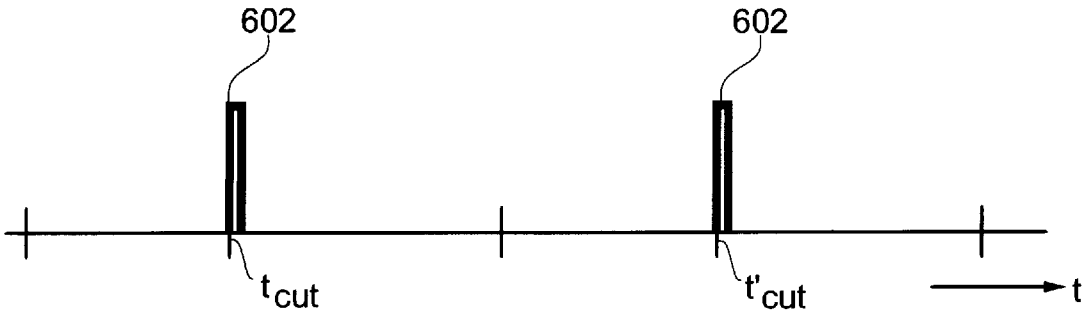

The switching signal shown in FIG. 6B is generated by control unit 308 constructed according to the invention. The time $t_{cut}$, the phase angle to be re-determined for each half-phase, is derived from phase angle $t_0$ according to the invention. The phase angle $t_0$ forms the set-point around which the phase cutting according to the invention is varied as will be illustrated hereinafter. This set-point $t_0$, which corresponds to a specific average power to be fed to the load, and which can be expressed as a duty cycle, i.e. as a percentage of the maximum power to be absorbed, is determined by control unit 308A.

Control unit 308A determines the power to be supplied to the load on the basis of an estimate of the temperature of the radiator slats on the basis of the measurement of NTC 218, the ambient temperature detected by NTC 219, the state of operation of the apparatus and the support material selected. These latter two parameters are fed to the control system by the central control unit 12. The power to be supplied is re-determined by control unit 308A every, e.g., 200 msec. The value of $t_0$ is thus renewed every 200 msec.

Figure 4:
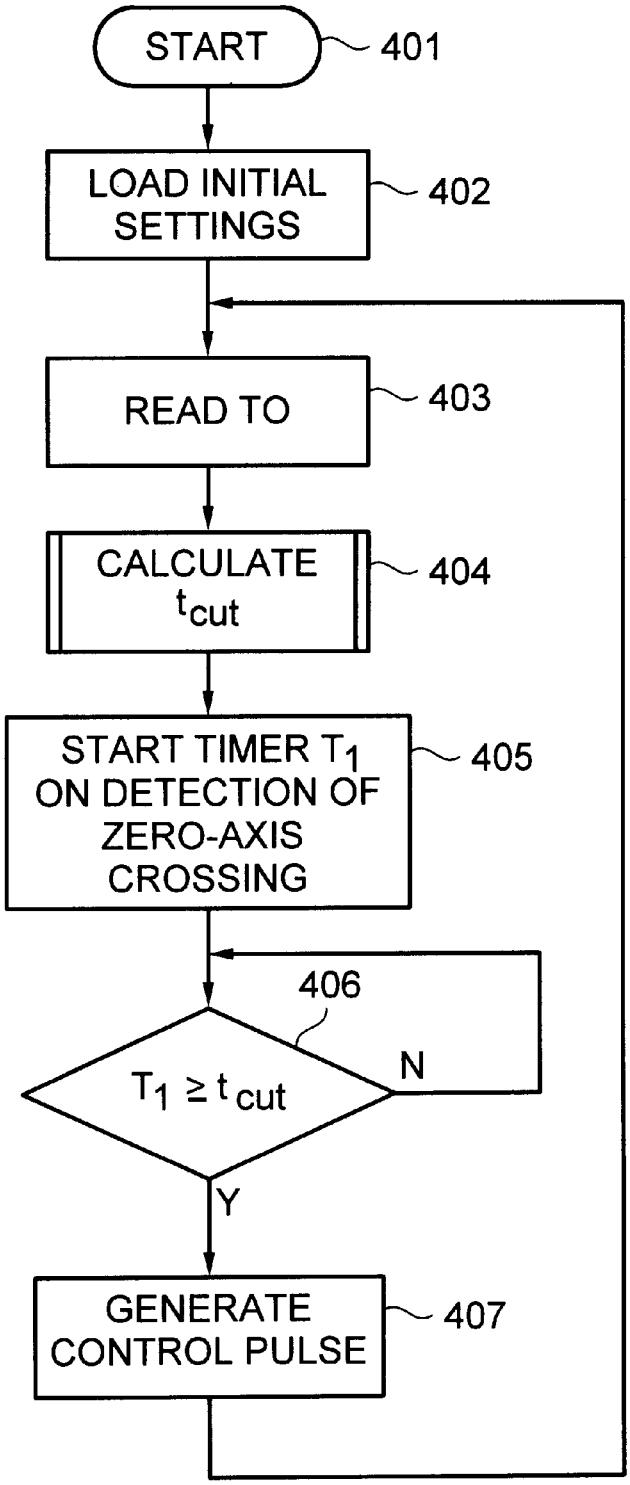
FIG. 4 is a first flow diagram of the control of the SSR according to the invention.
Figure 5:
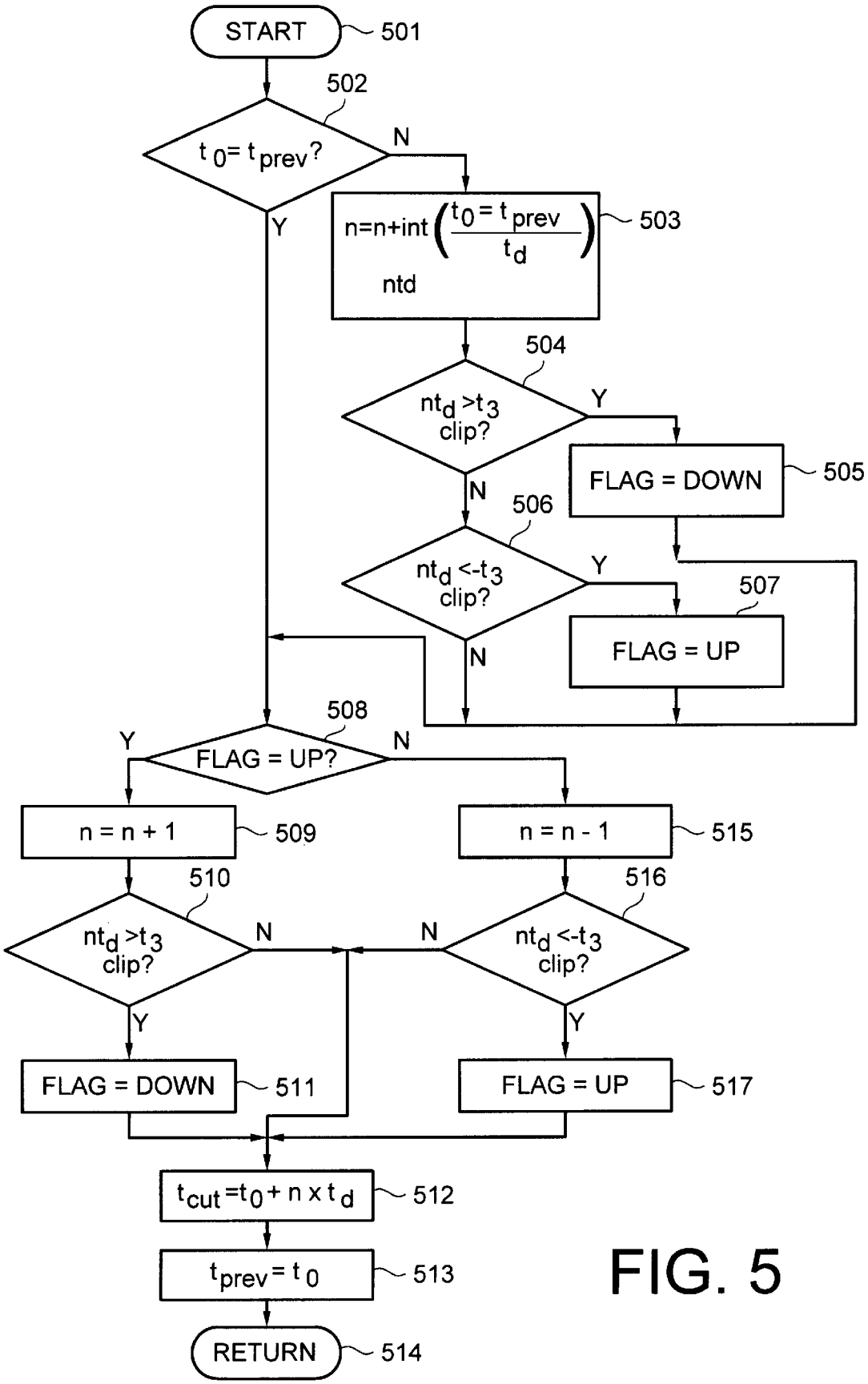
FIG. 5 is a second flow diagram of the control of the SSR according to the invention.

Control unit 308 is preferably a microcontroller. A flow diagram of the program provided therein for deriving $t_{cut}$ from $t_0$ is shown in FIGS. 4 and 5. Alternatively, the microcontroller could be embodied by discrete logic components or a programmable logic array (PLA). The quantities concerned will first be explained with reference to FIGS. 6A and 6B.

In FIG. 6A the signal 601 is the sinusoidal curve of the voltage as present in the main circuit 302 at the mains connection 301. Control circuit 308A calculates the power to be supplied instantaneously to the fixing unit on the basis of specific ambient conditions as explained hereinbefore. This power corresponds to a phase cut at time $t_0$. According to the invention, phase-cutting does not now take place at the time $t_0$ but at the varying time $_{cut}$.

These variations of $t_{cut}$ around $t_0$ take place within the limits determined by a swing window. The swing window is determined by the maximum admissible deviation, namely $t_3$, in either direction about $t_0$ and is clipped when it exceeds the limits of the half period determined by $t_3$. The time $t_{cut}$ traverses the swing window step-wise with index n. The index n varies between a negative extreme value and a positive extreme value corresponding to the extreme values of the swing window. A step is set each half-period so that the index n is increased by one or reduced by one each half period. On each step, $t_{cut}$ is increased or reduced by $t_d$. The position of $t_{cut}$ with respect to $t_0$ is now determined at each moment by the index n, which indicates the number of steps to the value of $t_d$ by which $t_{cut}$ is distant from $t_0$. FIG. 6B shows the switching signal 602 which is applied to the control electrode at the time $t_{cut}$.

The action of the power supply circuit according to the invention will now be explained with reference to the flow diagrams. Starting from the starting position 401 in FIG. 4, initial values are first allocated to a number of quantities in step 402. This will normally take place when the reproduction apparatus is switched on. These initial settings include the swing of the swing window $t_3$; the step $t_d$ by which the actual phase cut shifts each time on each phase cut; the set point $t_0$; $t_{prev}$, the previous value of $t_0$, is initially made equal to $t_0$; the signal FLAG, which indicates whether the shift of the phase cut is ascending or descending, is initially given the value UP; the index n is initially allocated the value 0.

The value of $t_0$ is read in step 403. Step 404 calculates $t_{cut}$, the time at which the phase cut must take place within the present half period. In step 405 a timer T1 is started on detection of a zero-cross, this timer runs until the time $t_{cut}$ has elapsed in step 406 (Y). In step 407, when $T_l$ is equal to or greater than $t_{out}$, a phase cut control signal is then applied to the control electrode 306. The time $T_0$ is again read in in step 403. This cycle is carried out each half period of the power supply voltage.

A detailed explanation of the calculation of $t_{cut}$ will be given with reference to FIG. 5. Starting from the starting position 501, step 502 checks whether $t_0$ has remained unchanged. If not (N), that implies that the position of the swing window is also changed; $t_{cut}$ will then approach the new swing window stepwise. For this purpose, step 503 calculates the new index n associated with the position of the present $t_{cut}$ but now determined from the new $t_0$ according to the equation $n=n+int((t_0-t_{prev})/t_d)$ If the new position is on the right of the swing window or on the right of the phase transition at the end of the present half period so that clipping is necessary (step 504, Y), e.g., $n_{td}>t_3$, where $t_3$ is the maximum deviation, from then the variable FLAG is allocated the value DOWN in step 505. If this is not the case (step 504, N), step 506 determines whether the new position is on the left of the swing window or on the left of the phase transition at the beginning of the present half period. If this is the case, then step 507 allocates the value UP to the variable FLAG. If this is not the case, a correction of the variable FLAG is unnecessary, only the new value of n is determined for the new situation. Step 508 is then reached.

Step 508 is also directly reached if $t_0$ has remained unchanged. In step 508 the value of the variable FLAG is checked. If adding up or incrementing is necessary (Y) then the index n is raised by 1 in step 509. Step 510 then checks whether $t_{cut}$ is on the right outside the swing window or on the right outside the present half period (clipping). If this is the case (Y), then the variable FLAG is allocated the value DOWN in step 511. Step 512 is then reached.

If step 508 finds that FLAG DOWN applies (N), then the index n is reduced by 1 in step 513. Step 516 checks whether $t_{cut}$ is on the left outside the swing window or on the left of the present half period. If that is the case, the variable FLAG is allocated the value UP in step 517. Step 512 is then carried out, in which $t_{cut}$ is determined according to the equation $t_{cut}=t_0+nXt_d$. Finally, in step 513, the variable $t_{prev}$ is allocated the value $t_0$ and the circuit returns at step 514 to step 405 of FIG. 4.

Improved suppression of higher harmonics is obtained by so selecting $t_3$ and $t_d$ that $t_3$ is not a whole multiple of $t_d$. When $t_{cut}$ passes through the swing window, an offset is then determined each time. This is $n*t_d-t_3$, where n is the value of the index at which the limit $t_3$ has just been passed. This offset varying on passing of an extreme limit is always added to $t_{cut}$. The effect of this is that the phase cut during another period of the passage through the swing window also takes place at a different time grid.

The influence of inaccuracies of zero-point detector and timers is reduced by defining around the zero-cross a range which is not necessarily symmetrical, for example a range of 400 microsec, at which, if $t_0$ or $t_{cut}$ is within that range, the switching signal 602 is suppressed.

Measurements on the circuit according to the invention have shown that an appreciable reduction of flicker and higher harmonics is obtained with a swing window ($2*t_3$) of, e.g., 3300 microsec and a step value $t_{delta}$ of, e.g., 160 microsec; the power supply voltage in this case is, e.g., 230 V, 50 Hz.

The circuit illustrated here is not limited to use for a fixing unit in a reproduction apparatus, but can be used anywhere in a reproduction apparatus machine where power is controlled by phase cutting and where the flicker induced on the mains and interference radiation are to be limited as much as possible, for example a paper preheating unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling the power supplied from an external electrical main circuit to a load in a reproduction device, said external electrical main circuit supplying a substantially sinusoidal signal of period P, the apparatus comprising:

a switch for controllably connecting said external electrical main circuit to said load;

a zero-cross detector for generating a zero-cross detection signal upon detection of a zero-crossing by said substantially sinusoidal signal of period P; and a controller for providing a control signal to said switch, said controller varying occurrences of said control signal in time by advancing or retarding a reference time, relative to but not coincidental with said zero-cross detection signal, with an adjustment value variably selected from a range of adjustment values.

2. The apparatus as in claim 1, wherein said controller periodically varies said occurrences.

3. The apparatus as in claim 2, wherein said controller varies said occurrences in time stepwise with a constant step size per elapsed half of said substantially sinusoidal signal.

4. The apparatus as in claim 3, wherein if said controller determines that an occurrence of said control signal corresponds to a first extremum of said range, then said controller uses a remaining step value as the adjustment value to determine the next occurrence.

5. The apparatus as in claim 1, wherein said load is a resistive heating element in fixing unit or a paper heating unit, the apparatus further comprising:

a temperature sensor for sensing temperature of said load and outputting a temperature signal indicative thereof;

wherein said controller determines said reference time as a function of said temperature.

6. The apparatus as in claim 5, wherein said temperature sensor is a first temperature sensor and said temperature signal is a first temperature signal, the apparatus further comprising:

a second temperature sensor for sensing temperature of an ambient environment in which is located said load and outputting a second temperature signal indicative thereof;

wherein said controller also determines said reference time as a function of said second temperature.

7. A reproduction apparatus comprising:

a fixing unit or a paper-heating unit, said fixing unit or paper-heating unit having a resistive load therein; and a power control circuit for controlling the power supplied from an external electrical main circuit to a load in a reproduction device, said external electrical main circuit supplying a substantially sinusoidal signal of period P, the power control circuit including:

a switch for controllably connecting said external electrical main circuit to said load;

a zero-cross detector for generating a zero-cross detection signal upon detection of a zero-crossing by said substantially sinusoidal signal of period P;

a controller for providing a control signal to said switch, said controller varying occurrences of said control signal in time by advancing or retarding a reference time, relative to but not coincidental with said zero-cross detection signal, with an adjustment value variably selected from a range of adjustment values; and a temperature sensor for sensing temperature of said load and outputting a temperature signal indicative thereof;

wherein said controller determines said reference time as a function of said temperature.

8. The reproduction apparatus as in claim 7, wherein said temperature sensor is a first temperature sensor and said temperature signal is a first temperature signal, the apparatus further comprising:

a second temperature sensor for sensing temperature of an ambient environment in which is located said load and outputting a second temperature signal indicative thereof;

wherein said controller also determines said reference time as a function of said second temperature.

9. A method for controlling the power supplied from an external electrical main circuit to a load in a reproduction device, said external electrical main circuit supplying a substantially sinusoidal signal of period P, the method comprising the steps of:

generating a zero-cross detection signal upon detection of a zero-crossing by said substantially sinusoidal signal of period P; and varying an activation point in time at which a control signal is applied to a switch that controllably connects said external electrical main circuit to said load by advancing or retarding a reference time, relative to but not coincidental with said zero-cross detection signal, with an adjustment value variably selected from a range of adjustment values.

10. The method as in claim 9, wherein said activation point is periodically varied.

11. The method as in claim 10, wherein said activation point is varied stepwise with a constant step size per elapsed half of said substantially sinusoidal signal.

12. The method as in claim 11, wherein if said activation point is determined to correspond to a first extremum of said range, then said remaining step value is used for as the adjustment value for determination of the next adjustment point.

13. The method as in claim 9, wherein said load is a resistive heating element in fixing unit or a paper preheating unit, the method further comprising:

sensing temperature of said load and outputting a temperature signal indicative thereof;

determining said reference time as a function of said temperature.

14. The method as in claim 13, wherein said temperature sensor is a first temperature sensor and said temperature signal is a first temperature signal, the method further comprising:

sensing temperature of an ambient environment in which is located said load and outputting a second temperature signal indicative thereof;

determining said reference time also as a function of said second temperature.

15. An apparatus for controlling the power supplied from an external electrical main circuit to a load in a reproduction device, said external electrical main circuit supplying a substantially sinusoidal signal of period P, the apparatus comprising:

a switch for controllably connecting said external electrical main circuit to said load;

a zero-cross detector for generating a zero-cross detection signal upon detection of a zero-crossing by said substantially sinusoidal signal of period P; and a controller for providing a switching signal at a phase angle varying in time with respect to but not coincidental with a zero-cross of a substantially sinusoidal signal present in the main circuit, the phase angle varying in time around a phase angle set-point determined by the power control signal indicative of power to be supplied to the load.

16. The apparatus for controlling the power supply to a fixing unit according to claim 15, wherein the phase angle varies in time periodically.

17. The apparatus for controlling the power supply according to claim 16, wherein the phase angle varies stepwise with a constant step size per elapsed half period.

18. The apparatus for controlling the power supply according to claim 17, wherein the phase angle varies periodically in time between two extreme values such that, when one extreme value is reached, the step value remaining at that time is used as an offset for a next phase angle for generation.

19. The apparatus for controlling the power supply according to claim 17, wherein, if a phase angle set-point varies from a first value to a second value, the phase angle is adapted stepwise with a constant step value per elapsed half period until the phase angle falls within extreme values associated with the second value.

20. The apparatus for controlling the power supply according to claim 15, wherein:

the load is in the form of a fixing unit for fixing toner images on a support material;

the apparatus further comprises a temperature sensor for generating a temperature signal which is an indication of the temperature of the fixing unit; and the power control signal is determined in dependence on the temperature of the fixing unit.

21. The apparatus for controlling the power supply according to claim 20, wherein:

the apparatus further comprises a second temperature sensor for generating a signal which is an indication of the ambient temperature, and the control unit is electrically connected to the second temperature sensor to receive an ambient temperature signal, the control unit comprising means for correcting the phase angle set-point on the basis of the ambient temperature signal.

* * * * *